United States Patent [19]

Terauchi

[11] Patent Number: 4,842,488

[45] Date of Patent: Jun. 27, 1989

[54] SLANT PLATE TYPE COMPRESSOR WITH VARIABLE DISPLACEMENT MECHANISM

[75] Inventor: Kiyoshi Terauchi, Gunma, Japan

[73] Assignee: Sanden Corporation, Gunma, Japan

[21] Appl. No.: 203,632

[22] Filed: Jun. 6, 1988

Related U.S. Application Data

[63] Continuation of Ser. No. 68,102, Jun. 30, 1987, abandoned.

[30] Foreign Application Priority Data

Jul. 8, 1986 [JP] Japan ..... 61-158680

[51] Int. Cl.[4] ..... F04B 1/28

[52] U.S. Cl. ..... 417/222; 417/269

[58] Field of Search ..... 417/222, 270, 280

[56] References Cited

U.S. PATENT DOCUMENTS

| | | | |
|---|---|---|---|
| 1,935,544 | 11/1933 | DeLancey | 417/282 X |
| 3,010,403 | 11/1961 | Zubaty . | |
| 3,062,020 | 11/1962 | Heidorn . | |
| 3,759,057 | 9/1973 | English et al. . | |
| 4,037,993 | 7/1977 | Roberts . | |
| 4,061,443 | 12/1977 | Black et al. . | |
| 4,073,603 | 2/1978 | Abendschein et al. . | |
| 4,157,233 | 6/1979 | Horiuchi . | |
| 4,174,191 | 11/1979 | Roberts | 417/222 |
| 4,231,713 | 11/1980 | Widdowson et al. . | |
| 4,428,718 | 1/1984 | Skinner . | |
| 4,459,817 | 7/1984 | Inagaki et al. . | |
| 4,475,871 | 10/1984 | Roberts . | |
| 4,480,964 | 11/1984 | Skinner . | |
| 4,502,844 | 3/1985 | Kimura et al. . | |
| 4,526,516 | 7/1985 | Swain et al. | 417/222 |
| 4,533,299 | 8/1985 | Swain et al. . | |
| 4,557,670 | 12/1985 | Inagaki et al. . | |
| 4,606,705 | 8/1986 | Parekh | 417/222 |
| 4,632,640 | 12/1986 | Terauchi . | |
| 4,664,604 | 5/1987 | Terauchi | 417/222 |
| 4,669,272 | 6/1987 | Kawai et al. . | |
| 4,687,419 | 8/1987 | Suzuki et al. | 417/222 |
| 4,688,997 | 8/1987 | Suzuki et al. | 417/222 |
| 4,702,677 | 10/1987 | Takenaka et al. . | |
| 4,717,314 | 1/1988 | Sato et al. . | |
| 4,747,753 | 5/1988 | Taguchi . | |

FOREIGN PATENT DOCUMENTS

| | | | |
|---|---|---|---|
| 0190013 | 6/1986 | European Pat. Off. . | |
| 0219283 | 3/1987 | European Pat. Off. . | |
| 59-51181 | 3/1984 | Japan . | |
| 55380 | 3/1986 | Japan | 417/222 |
| 145379 | 7/1986 | Japan | 417/222 |
| 2153922 | 8/1985 | United Kingdom . | |

OTHER PUBLICATIONS

European Search Report, EP 87 30 6039.

*Primary Examiner*—William L. Freeh

*Attorney, Agent, or Firm*—Banner, Birch, McKie & Beckett

[57] ABSTRACT

A slant plate type compressor with a capacity or displacement adjusting mechanism is disclosed. The compressor includes a housing having a cylinder block provided with a plurality of cylinders and a crank chamber. A piston is slidably fitted within each of the cylinders and is reciprocated by a drive mechanism which includes a member having a surface with an adjustable incline angle. The incline angle is controlled by the pressure situation in the crank chamber. The pressure in crank chamber is controlled by control mechanism which comprises a passageway communicating between the crank chamber and a suction chamber and valve device to control the closing and opening of the passageway. The valve device includes a valve element which directly controls the closing and opening of passageway, a first valve control device which controls operation of the valve element in response to pressure in the suction chamber, and a second valve control device which controls a predetermined operating point of the first valve control device. The operation of the second valve control device is controlled in response to changes in conditions external of the compressor.

16 Claims, 6 Drawing Sheets

SLANT PLATE TYPE COMPRESSOR WITH VARIABLE DISPLACEMENT MECHANISM

This application is a continuation of application Ser. No. 068,102, filed June 30, 1987, now abandoned.

TECHNICAL FIELD

The present invention relates to a refrigerant compressor, and more particularly, to a slant plate type compressor, such as a wobble plate type compressor, with a variable displacement mechanism suitable for use in an automotive air conditioning system.

BACKGROUND OF THE INVENTION

Generally, in air conditioning apparatus, thermal control is accomplished by intermittent operation of the compressor in response to a signal from a thermostat located in the room being cooled. Once the temperature in the room has been lowered to a desired temperature, the refrigerant capacity of the air conditioning system generally need not be very large in order to handle supplemental cooling because of further temperature changes in the room or to keep the room at the desired temperature. Accordingly, after the room has cooled down to the desired temperature, the most common technique for controlling the output of the compressor is by intermittent operation of the compressor. However, this intermittent operation of the compressor results in the intermittent application of a relatively large load to the driving mechanism of the compressor.

In automobile air conditioning compressors, the compressor is driven by the engine of the automobile through an electromagnetic clutch. Automobile air conditioning compressors face the same intermittent load problems described above once the passenger compartment reaches a desired temperature. Control of the compressor normally is accomplished by intermittent operation of the electromagnetic clutch which couples the automobile engine to the compressor. Thus, the relatively large load which is required to drive the compressor is intermittently applied to the automobile engine.

Furthermore, since the compressor of an automobile air conditioner is driven by the engine of the automobile, the rotation frequency of the drive mechanism changes from moment to moment, which causes the refrigerant capacity to change in proportion to the rotation frequency of the engine. Since the capacity of the evaporator and the condenser of the air conditioner does not change when the compressor is driven at high rotation frequency, the compressor performs useless work. To avoid performing useless work, prior art automobile air conditioning compressors often are controlled by intermittent operation of the magnetic clutch. However, this again results in a large load being intermittently applied to the automobile engine.

One solution to above mentioned problems is to control the capacity of the compressor in response to refrigeration requirements. One construction to adjust the capacity of a slant plate type compressor, particularly a wobble plate type compressor, is disclosed in the U.S. Pat. No. 3,861,829 issured to Roberts et al. Roberts et al. '829 discloses a wobble plate type compressor which has a cam rotor driving device to drive a plurality of pistons and varies the slant angle of a slant surface to change the stroke length of the pistons. Since the stroke length of the pistons within the cylinders is directly responsive to the slant angle of the slant surface, the displacement of the compressor is easily adjusted by varying the slant angle. Furthermore, variations in the slant angle can be effected by the pressure difference between a suction chamber and a crank chamber in which the driving device is located.

In these prior art compressors, the slant angle of the slant surface is controlled by pressure in the crank chamber. Typically this control occurs in the following manner. The crank chamber communicates with the suction chamber through an aperture and the opening and closing of the aperture is controlled by value mechanism. The value mechanism generally includes a bellows element and a needle valve, and is located in the suction chamber so that the bellows element operates in accordance with changes of pressure in the suction chamber. The acting point of valve mechanism at which it opens or closes the aperture is determined by the pressure of the gas contained in bellows element. The acting point of bellows element is thus fixed at a predetermined value. The bellows element therefore operates only at a certain change of the pressure in the suction chamber, and can not respond to various changes of refrigerating conditions since the bellows element is set to act at a single predetermined pressure. Furthermore, since the predetermined acting point of the bellows element can not be changed, the valve can not be made responsive to requirements such as when the air conditioner requires an especially low evaporating temperature or the compressor must operate with small volume for decreasing thermal loads. Also, for the purpose of reducing the number of parts in a compressor an electromagnetic clutch can be omitted and the compressor can be directly connected to a driving source. In this type of compressor, the compressor is driven whenever the driving source is operating. Operation of this type of compressor is especially difficult when the value of the predetermined operating point of bellows element can not be changed with changes in the thermal load of an evaporator in a refrigerant circuit.

Roberts et al. '829 discloses the capacity adjusting mechanism used in a wobble plate type compressor. As is typical in this type of compressor, the wobble plate is disposed at a slant or incline angle relative to the drive axis, nutates but does not rotate, and drivingly couples the pistons to the drive source. This type of capacity adjusting mechanism, using selective fluid communication between the crank chamber and the suction chamber, however, can be used in any type of compressor which uses a slanted plate or surface in the drive mechanism. For example, U.S. Pat. No. 4,664,604, issued to Terauchi, discloses this type of capacity adjusting mechanism in a swash plate type compressor. The swash plate, like the wobble plate, is disposed at a slant angle and drivingly couples the pistons to the drive source. However, while the wobble plate only nutates, the swash plate both nutates and rotates. The term slant plate type compressor will therefore be used herein to refer to any type of compressor, including wobble and swash plate types, which use a slanted plate or surface in the drive mechanism.

SUMMARY OF THE INVENTION

It is a primary object of the invention to provide a slant plant type compressor with a variable displacement mechanism wherein the capacity control can be adjusted.

It is another object of this invention to provide a slant plate type compressor with a variable displacement mechanism which can be utilized in various types of refrigerating apparatus.

A slant plate type compressor in accordance with the present invention includes a compressor housing having a front plate at one of its ends and a rear end plate at its other end. A crank chamber and a cylinder block are located in the housing; and a plurality of cylinders are formed in the cylinder block. A piston is slidably fit within each of the cylinders and is reciprocated by a driving mechanism. The driving mechanism includes a drive shaft, a drive rotor coupled to the drive shaft and rotatable therewith, and a coupling mechanism which drivingly couples the rotor to the pistons such that the rotary motion of the rotor is converted to reciprocating motion of the pistons. The coupling mechanism include a member which has a surface disposed at an incline angle relative to the drive shaft. The incline angle of the member is adjustable to vary the stroke length of the reciprocating pistons and thus vary the capacity or displacement of the compressor. The rear end plate surrounds a suction chamber and a discharge chamber. A passageway provides fluid communication between the crank chamber and the suction chamber. An incline angle control device is supported in the compressor and controls the incline angle of the coupling mechanism member is response to the pressure condition in the compressor. The incline angle control device has a control valve mechanism which includes a valve that directly controls communcation between the crank chamber and the suction chamber through the passageway, and first and second valve control mechanisms. The first valve control mechanism controls operation of the valve to close and open the passageway in response to the refrigerant pressure in the suction chamber. The second valve control mechanism is coupled to the first valve control mechansim and controls the operating point of the first valve control mechanism in response to changes in external conditions such as the thermal load of an evaporator in the refrigerant circuit.

Further objects, features and other aspects of this invention will be understood from the following detailed description of preferred embodiments of this invention with reference to the annexed drawings.

DETAILED DESCRIPTION OF THE PREFERRED EMBODIMENTS

Figure 1:
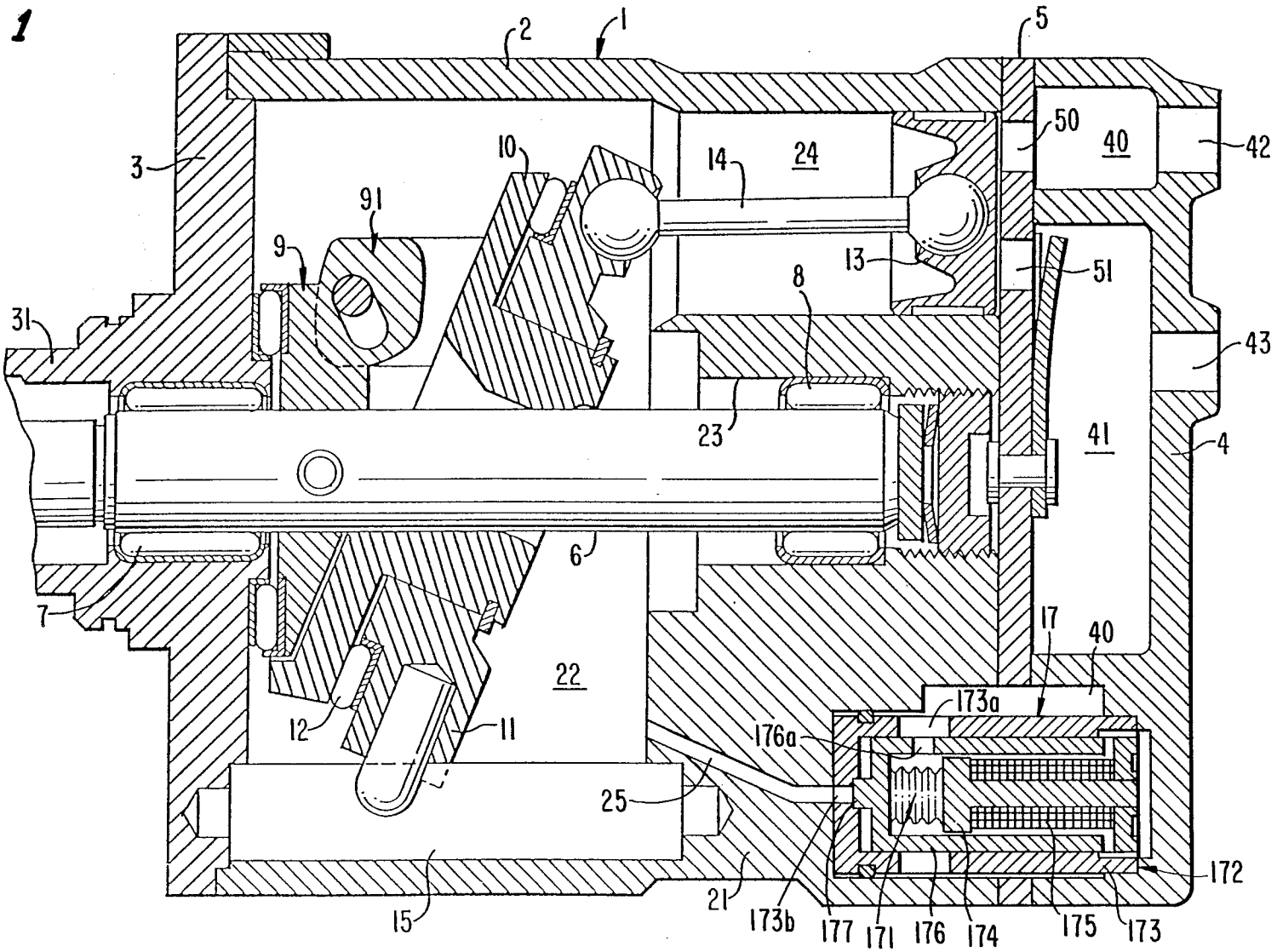
FIG. 1 is a cross-sectional view of a slant plate type compressor with a variable displacement mechanism in accordance with one embodiment of this invention.

Referring to FIG. 1, the construction of slant plate type compressor, specifically a wobble plate type compressor, with a variable displacement mechanism in accordance with a first embodiment of this invention is shown. Compressor 1 includes a closed housing assembly formed by a cylindrical compressor housing 2, a front end plate 3 and a rear end plate in the form a cylinder head 4. A cylinder block 21 and a crank chamber 22 are located in compressor housing 2. Front end plate 3 is attached to one end surface of compressor housing 2, and cylinder head 4 which is disposed on the other end surface of compressor housing 2 is fixed on one end surface of cylinder block 21 through a valve plate 5. An opening 31 is formed in the central portion of front end plate 3 to received a drive shaft 6.

Drive shaft 6 is rotatable supported on front end plate 3 through a bearing 7. An inner end portion of drive shaft 6 also extends into a central bore 23 formed in the central portion of cylinder block 21 and is rotatable supported therein by bearing 8. A rotor 9, disposed in the interior of crank chamber 22, is connected to drive shaft 6 to be rotatable with the drive shaft and engages an inclined plate 10 through an hinge portion 91. The incline angle of inclined plate 10 with respect to drive shaft 6 can be adjusted by hinge portion 91. A wobble plate 11 is disposed on the other side surface of inclined plate 10 and bears against it through a bearing 12.

A plurality of cylinders 24, one of which is shown in FIG. 1, are equiangularly formed in cylinder block 21, and a piston 13 is reciprocatingly disposed within each cylinder 24. Each piston 13 is connected to wobble plate 11 through a connecting rod 14, i.e., one end of each connecting rod 14 is connected to wobble plate 11 with a ball joint and the other end of each connecting rod 14 is connected to one of pistons 13 with a ball joint. A guide bar 15 extends within crank chamber 22 of comprssor housing 2. The lower end portion of wobble plate 11 engages guide bar 15 to enable wobble plate 11 to reciprocate along guide bar 15 while preventing rotating motion.

Pistons 13 are thus reciprocated in cylinders 24 by a drive mechanism formed of drive shaft 6, rotor 9, incline plate 10, wobble plate 13 and connecting rods 14. Drive shaft 6 and rotor 9 are rotated; and incline plate 10, wobble plate 13 and connecting rods 14 function as a coupling mechanism to convert the rotating motion of the rotor into reciprocating motion of the pistons.

Figure 1A:
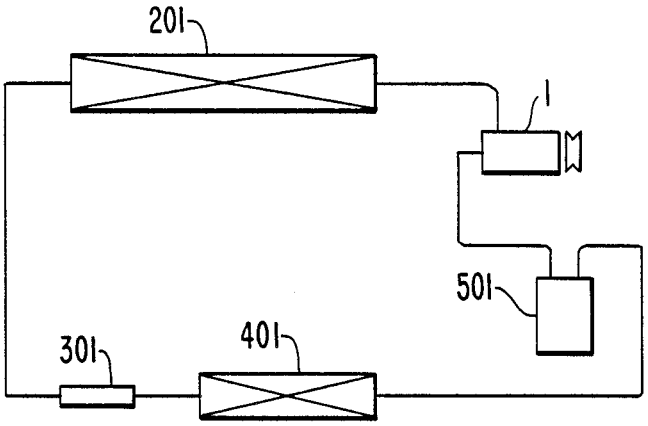
FIG. 1*a* is a schematic drawing of a conventional refrigerant circuit within which the compressor of the present invention can be used.

Cylinder head 4 is provided with a suction chamber 40 and a discharge chamber 41, both of which communicate with cylinders 24 through suction holes 50 or discharge holes 51 formed through valve plate 5, respectively. Also, cylinder head 4 is provided with an inlet port 42 and an outlet port 43 which place suction chamber 40 and discharge chamber 41 in fluid communication with a refrigerant circuit. FIG. 1*a* schematically illustrates a typical refrigerant circuit wherein compressor 1 is connected in series to a condensor 201, an orifice tube 301 as an expansion device, an evaporator 401 and an accumulator 501.

A bypass hole or passageway 25 is formed in cylinder block 21 to communicate between suction chamber 40 and crank chamber 22. The communication between chambers 40 and 22 is controlled by a control valve mechanism 17. Control valve mechanism 17 is located in suction chamber 40 and comprises a bellows element 171 and a solenoid actuator 172. Bellows element 171 is a typical elongate, generally cylindrical shaped bellows. Solenoid actuator 172 comprises a casing 173, a T-shaped core 174, a solenoid (coil) 175 and a movable cylinder 176. Casing 173 is generally cylindrical, and has a U-shaped cross-section and openings 173*a*, 173*b* which provide communication between crank chamber 22 and suction chamber 40. Solenoid 175 is located about the outer surface of the axis of core 174. Movable cylindrical 176 has a U-shaped cross-section which covers solenoid 175 and is axially movably within casing 173. One opening 173*b* is formed through an end plate portion of casing 173 and communicates with one end opening of passageway 25. A projection 177 formed on one end plate portion of cylinder 176 functions to selectively close opening 173*b*. The other openings 173*a* are formed through the outer peripheral portion of casing 173 to provide communcation between the interior space of casing 173 and suction chamber 40. The outer peripheral portion of cylinder 176 has at least one opening 176*a* to provide communication to suction chamber 40 through opening 173*a* for the exterior of bellows element 171. Bellows element 171 is located in the interior space of cylinder 176 between cylinder 176 and core 174 in such a manner that the end surface of bellows 171 are attached to one end surface of movable cylinder 176 and one end surface of core 174, respectively. The interior of bellows element 171 is evacuated and sealed in a vacuous state.

When solenoid 175 is not energized, operation of bellows element 171 is determined by the pressure of refrigerant gas in suction chamber 40 operating against the inherent stiffness of spring effect of bellows element 171. When the pressure in suction chamber 40 is lower than the stiffness or spring effect of bellows element 171, bellows element 171 pushes or biases cylinder 176 the left so that projection 177 closes opening 173*b* of casing 173. Thus, communication between suction chamber 40 and crank chamber 22 through passageway 25 is obstructed. Under this condition the pressure in crank chamber 22 gradually increase because blow-by gas leaks into crank chamber 22 through a gap between the inner wall surface of cylinder 24 and the outer surface of piston 13. Gas pressure in the crank chamber acts on the rear surface of piston 13, and changes the balance of moment of inclined plate 10. The angle of inclined plate 10 relative to drive shaft 6 is thereby decreased; and the stroke of piston 13 is thus also decreased. As a result, the volume of refrigerant gas taken into cylinder 24 is decreased. The capacity of the compressor is thus varied.

On the other hand, if the pressure in suctionn chamber 40 exceeds the stiffness or spring effect of bellows element 171, bellows element 171 and cylinder 176 are pushed toward right against the inherent stiffness of bellows element 171, and projection 177 of cylinder 176 moves out of opening 173*b* of casing 173 of control valve mechanism 17. Accordingly, crank chamber 22 is placed in fluid communication with suction chamber 40 through passageway 25. The refrigerant gas in crank chamber 22 flows into suction chamber 40 through passageway 25, and the pressure in crank chamber 22 is decreased. Gas pressure which acts on the rear surface of piston 13 also decreases in accordance with decreasing of the gas pressure in crank chamber 22. The balance of moments acting on inclined plate 10 thus increases so that the angle of inclined plate 10 relative to drive shaft 6 also changes. The stroke of piston 13 is thus increased, and the volume of refrigerant gas being compressed is increased.

When solenoid 175 is energized, a magnetic force for attracting movable cylinder 176 toward right is produced by solenoid 175. The inherent stiffness or spring effect of bellows element 171 is set to be greater than the magnetic force, so that opening 173*b* is closed by projection 177 of movable cylinder 176 even when solenoid 175 is energized. However, since the magnetic force attracting movable cylinder 176 acts against bellows element 171, bellows element 171 is more easily collapsed than when solenoid 175 is not energized. Solenoid actuator 172 thus acts as a mechanism which reduces the amount of biasing force provided by bellows element 171; and since the amount of magnetic force is adjustable, as will be explained, this reduction in biasing force is likewise adjustable. In other words, the acting point of bellows element 171 i.e. the pressure level within suction chamber 40 which causes bellows element 171 to collapse and projection 177 to move between the closed and open positions, is changed by energization of solenoid 175. Bellows element 171 operates at different acting point. The displacement control sequence which is described above therefore occurs at a different acting point or suction pressure level.

The strength of the magnetic force produced by solenoid 175 is changed by varying the amount of electric current supplied to solenoid 175. The acting point of bellows element 171 is, therefore, controlled by the amount of supplied electric current which in turn can be controlled by changes in conditions external of the compressor. As a result, the stroke of piston 13 can be likewise changed in correspondence with any change in external conditions, e.g. any change in the thermal load of an evaporator in a refrigerant circuit or any other requirements specified from driving conditions, such as engine start or car acceleration. The change in external condition is sensed and used is generate the varying amount of electric current as is known in the art.

Figure 2A:
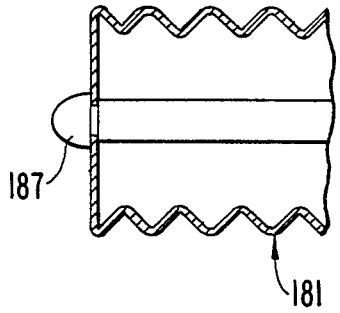
FIG. 2*a* is a sectional view illustrating a bellows element for use in the variable displacement mechanism of FIG. 2.
Figure 2:
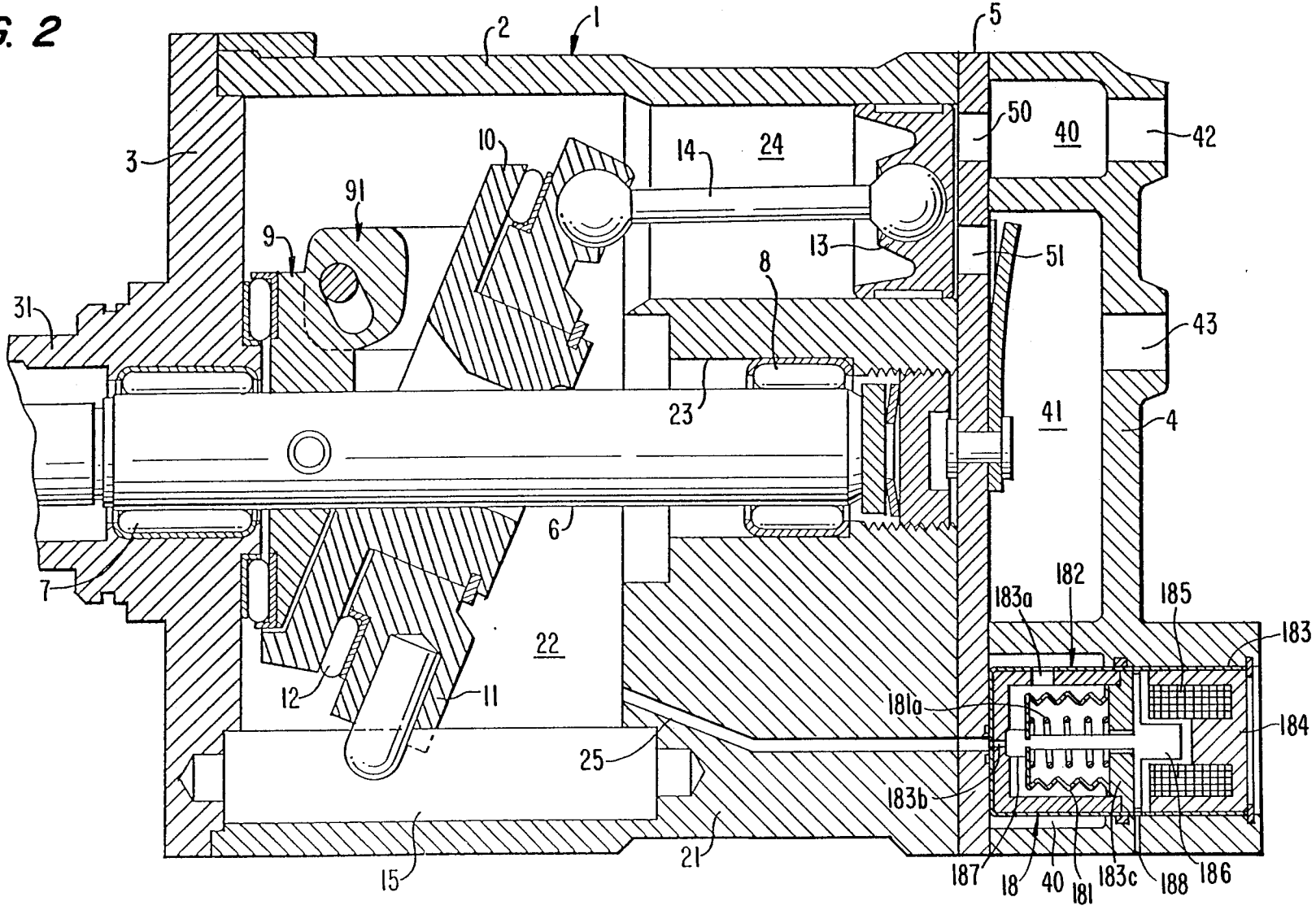
FIG. 2 is a cross-sectional view of a slant plate type compressor with a variable displacement mechansim in accordance with another embodiment of the invention.

The structure of the valve mechanism may be modified to the simplified structure shown in FIG. 2. In this structure, control valve mechanism 18 comprises a bellows element 181 and a solenoid actuator 182. Solenoid actuator 182 comprises casing a 183, a core 184, a solenoid 185, and a generally T-shaped movable member 186. Casing 183 is generally cylindrical and has U-shaped cross-section. Openings 183*a*, 183*b* are formed through casing 183 to provide communication between crank chamber 22 and suction chamber 40. Solenoid 185 is disposed on the outer surface of the axis of core 184, and T-shaped movable member 186 is movable disposed in the axial direction within bellows element 181. One end of bellows element 181 is attached on an end surface of a dividing wall 183*c* of casing 183, and a projection 187 extends from its other end. Projection 187 is connected with one end of movable member 186, and motion of movable member 186 is controlled by solenoid 185. A communicating channel 188 is formed within cylinder head 4 in order to provide the interior of bellows 181 with communication to ambient air. The inherent stiffness or spring affect of bellows element 181 provides the bias force to the left closed position as in FIG. 2*a*; or, if more force is needed to reinforce the stiffness of bellows element 181, a spring 181*a* can be incorporated in the interior of bellows element 181 as shown in FIG. 2. Since operation of control valve mechanism 18 is similar to the described in the first embodiment, i.e. by supplying varying amount of current to the solenoid, the description of the operation of control valve mechanism 18 is omitted. In the second embodiment, since the interior of bellows 181 communicates with ambient air, it is not necessary to seal solenoid 185.

Figure 3:
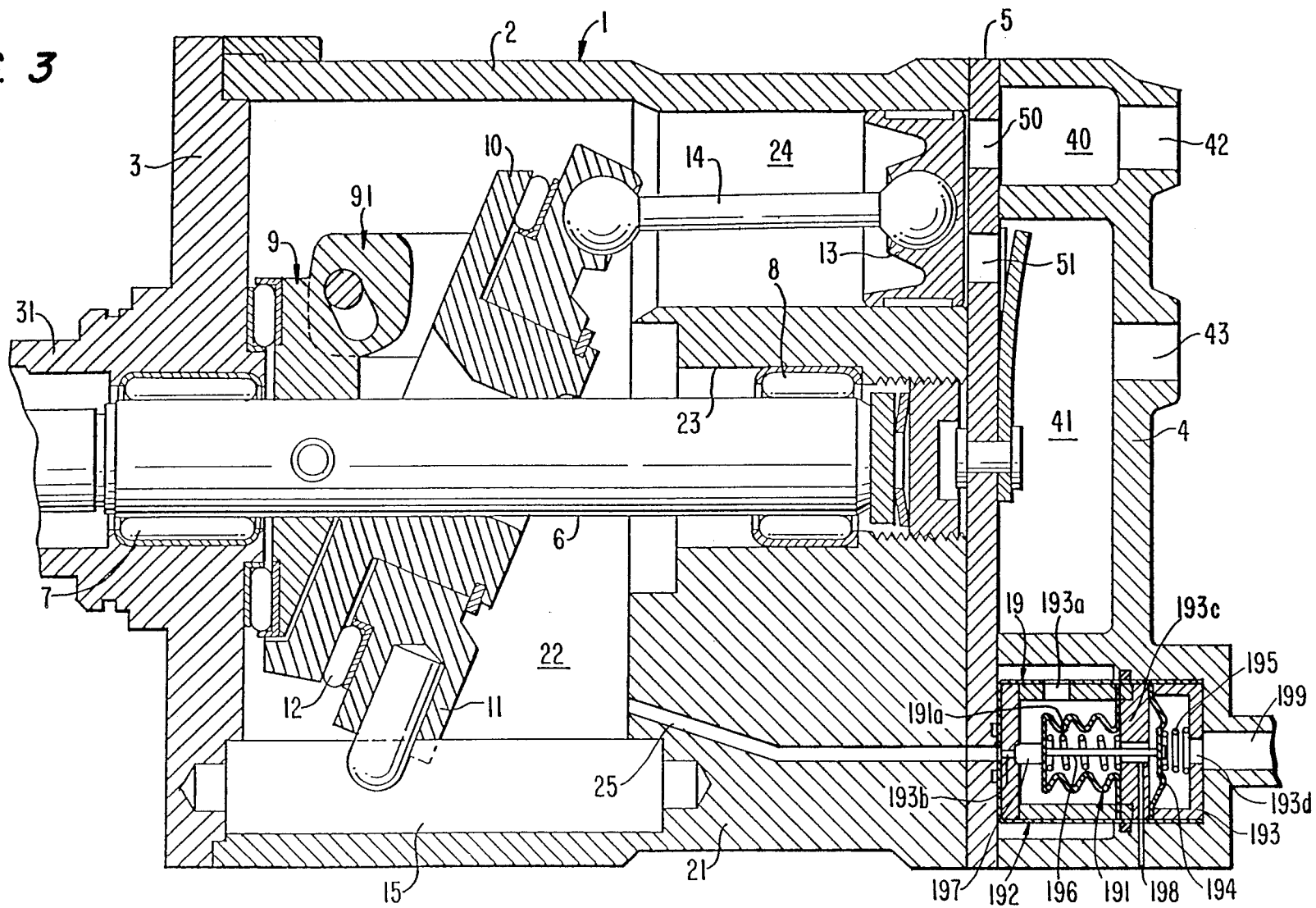
FIG. 3 is a cross-sectional view of a slant plate type compressor with a variable displacement mechansim in accordance with still another embodiment of this invention.

Referring to FIG. 3, control valve mechanism 19 comprises a bellows element 191 and a diaphram actuator 192. Bellows element 191 is a typical elongate, generally cylindrical shaped bellows; and diaphragm actuator 192 is also a type of bellows element, however, of the simplified, generally flat diaphragm type. Diaphram actuator 192 comprises a casing 193, a diaphram 194, a coil spring 195 and a connecting rod 196. Openings 193*a*, 193*b* are formed through casing 193 to provide fluid communication between suction chamber 40 and crank chamber 22. Connecting rod 196 is movably disposed in the axial direction within bellows element 191. Bellows element 191 is attached on one end surface of dividing wass 193*c* of casing 193, and needle valve 197 is attached to the opposite end of bellows element 191. A spring 191*a* is disposed within bellows element 191 and bears against dividing wall 193*c*. Diaphram 194 is attached to the opposite end surface of dividing wass 193*c*. One end of connecting rod 196 is connected to needle valve 197 through bellows element 191 and the other end of connecting rod 196 is connected to one end surface of diaphram 194. An inner end surface of casing 193 is coupled to the other end surface of diaphram 194 through coil spring 195. Communicating channel 198 is formed through dividing wall 193*c* and cylinder head 4 to place the interior defined by bellows element 191 and diaphram 194 in communication with ambient air. Opening 199 is formed through cylinder head 4 and communicates with opening 193*d* in casing 193. Opening 199 and 193*d* place the exterior of diaphram 194 in fluid communication with a tube that communicates air pressure for controlling the force applied by diagram 194 to connecting rod 196. Negative air pressure from an engine can be used.

Since operation of control valve mechanism 19 is similar to that described in the first embodiment, the description of the operation of control valve mechanism 19 is omitted. That is, as varying amounts of electric current were supplied to solenoid 175 in response to changing external conditions, varying amounts of negative pressure are supplied to opening 199 in a conventional manner due to sensed changes in external conditions.

Figure 4:
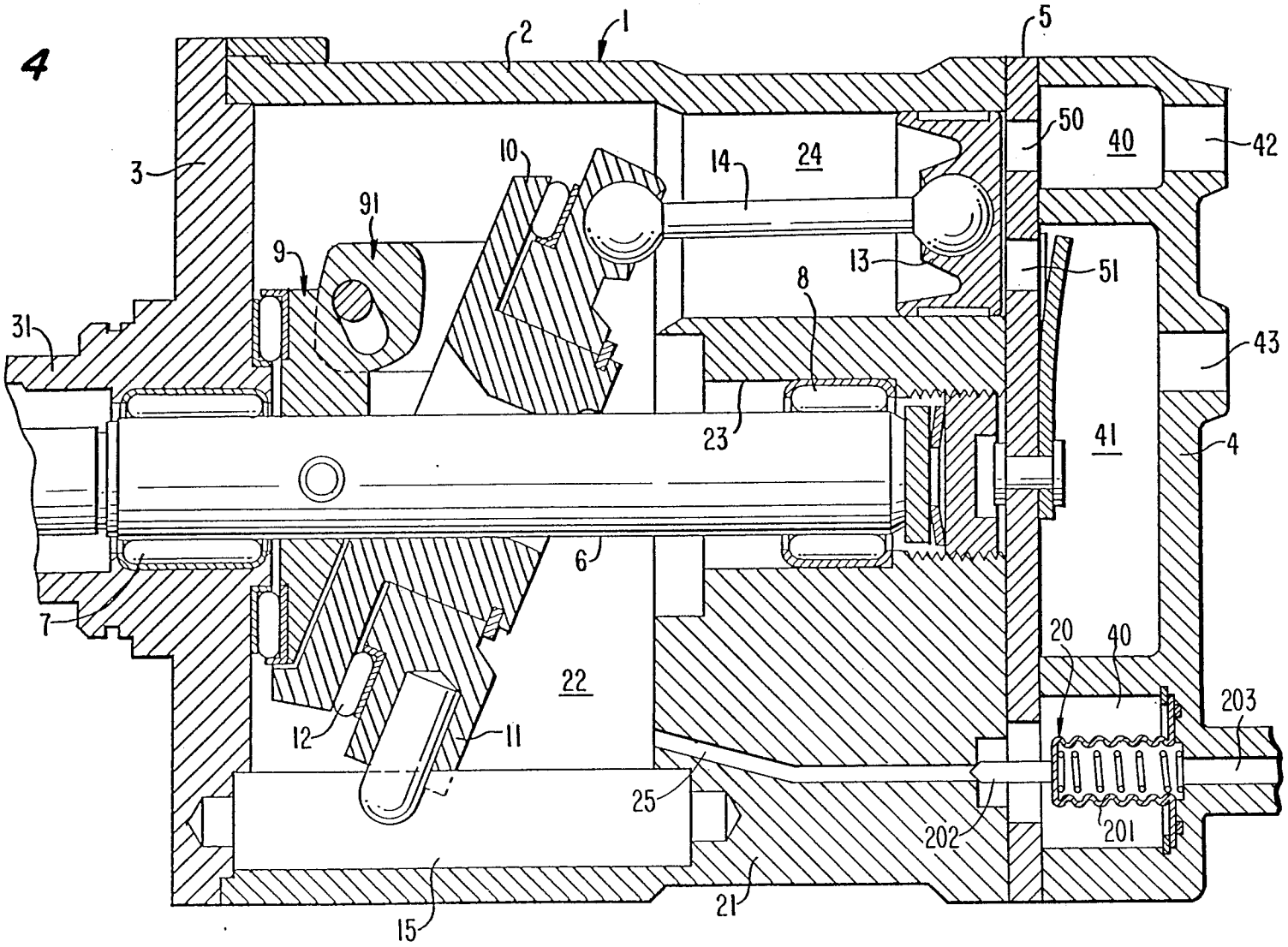
FIG. 4 is a cross-sectional view of a slant plate type compressor with a variable displacement mechanism in accordance with still another embodiment of this invention.

Referring to FIG. 4, control valve mechanism 20 comprises bellows element 201 which is disposed in suction chamber 40. Bellows element 201 is a typical elongate, generally cylindrical shaped bellows. Bellows element 201 is provided with needle valve 202 on one of its end surface and the other end of bellows element 201 is attached on an inner end surface of cylinder head 4. A spring 201*a* is disposed within bellows element 201. Opening 203 is formed through cylinder head 4 to place the interior of bellows element 201 in communication with a tube that provides varying negative air pressure for controlling valve mechanism 20. Therefore, the predetermined acting point of bellows element 201 is controlled by the air pressure provided through tube 203. As with the embodiment of FIG. 3, the level of the supplied negative air pressure can be varied in response to a sensed external condition.

Figure 5:
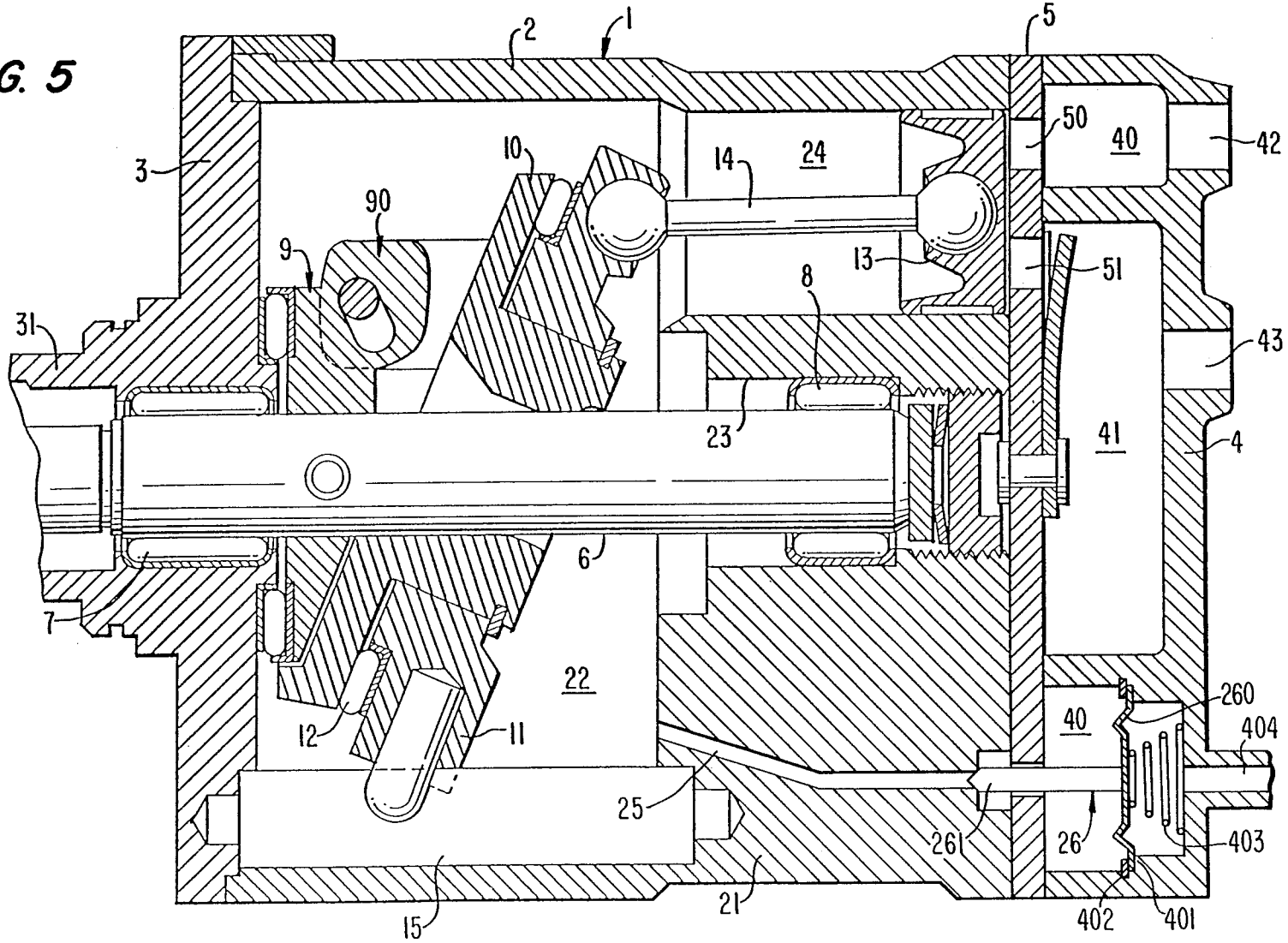
FIG. 5 is a cross-sectional view of a slant plate type compressor with a variable displacement mechanism in accordance with still another embodiment of this invention.

Referring to FIG. 5, above mentioned bellows element 201 may be replaced with a diaphram 260 which is disposed in suction chamber 40 and functions as a simplified bellows element. That is, diaphragm 260 is considered generically a bellows element, but with a simplified, generally flat shape, rather than a cylindrical shape. Diaphram 260 is provided with needle value 261 extending from one of its end surfaces, and is fixed on a projecting portion 401 of suction chamber 40 by a stopper 402. A coil spring 403 acts on the other end surface of diaphram 260 to bias needle valve 261 toward the opening of passageway 25. An opening 404 is formed through cylinder head 4 to place the exterior of diaphram 260 in communication with a tube that provides varying negative air pressure for control of the valve mechanism. Therefore, the predetermined opening point of diaphram 260 is controlled by the negative air pressure supplied through opening 404.

The present invention has been described in connection with the preferred embodiments. However, the preferred embodiments are merely examples and the invention is not restricted thereto. It will be understood by those skilled in the art that variation and modification can be made within the scope of the present invention as defined by the appended claims. Thus, while the preferred embodiments illustrate the invention in a wobble plate type compressor, the invention can be used in any slant plate type compressor. Also, while the disclosed embodiments illustrate the bellows element opening and closing the passageway in response to changes of pressure in the suction chamber, changes of pressure in other areas of the compressor, such as in the crank chamber, can also be used to open and close the passageway.

I claim:

1. In a slant plate type compressor for use in a refrigeration circuit, said compressor including a compressor housing having a central portion, a front end plate at one end and a rear end plate at its other end, said housing having a cylinder block provided with a plurality of cylinders and a crank chamber adjacent said cylinder block, a piston slidably fitted within each of the said cylinders, a drive mechanism coupled to said pistons to reciprocate said pistons within said cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an incline angle relative to said drive shaft, said incline angle of said member being adjustable to vary the stroke length of said pistons and the capacity of the compressor, said rear end plate having a suction chamber and a discharge chamber, a passageway connected between said crank chamber and said suction chamber, and valve means for controlling the closing and opening of said passageway to vary the capacity of the compressor by adjusting the incline angle, the improvement comprising said valve means including a valve to directly close and open said passageway, first valve control means for controlling the movement of said valve to open and close said passageway in response to changes in refrigerant pressure in said compressor, said first valve control means comprising a bellows element for applying a biasing force in a direction toward the closed position of said valve, and second valve control means coupled to said first valve control means for changing the operating point of said first valve control means in response to an external condition, said second valve control means including means for applying an adjustable negative pressure force to said bellows element to adjustably reduce the biasing force of said first valve control means, said means for applying the negative pressure force including a conduit for coupling to a source of variable negative pressure.

2. The refrigerant compressor of claim 1 wherein said bellows element comprises a generally cylindrical shaped collapsible bellows, and second valve control means further includes a diaphragm coupled to said bellows and movable in response to the adjustable negative pressure applied through said conduit.

3. The refrigerant compressor of claim 1 wherein said second valve control means comprises a pressure sensing means which controls the operating point of said first valve control means in response to negative pressure sensed by it.

4. The refrigerant compressor of claim 1 wherein said means for applying an adjustable force to said bellows element further comprises a movable diaphram and connecting rod, said connecting rod being coupled between said bellows element and said diaphram, and said diaphram being movable in response to the adjustable negative pressure applied through said conduit.

5. The refrigerant compressor of claim 1 wherein said first and second valve control means comprises single pressure sensing means, the operating point of said single pressure sensing means being controlled in response to negative pressure sensed by it.

6. The refrigerant compressor of claim 5 wherein said single pressure sensing means is a cylindrical shaped collapsible bellows.

7. The refrigerant compressor of claim 5 wherein said single pressure sensing means is a diaphram.

8. The refrigerant compressor of claim 1 wherein said conduit communicates directly with said bellows element.

9. The refrigerant compressor of claim 8 wherein said bellows element comprises a generally cylindrical shaped collapsible bellows.

10. The refrigerant compressor of claim 8 wherein said bellows element comprises a movable diaphram.

11. A slant plate type refrigerant compressor for use in a refrigeration circuit comprising:

a compressor housing having a crank chamber and a suction chamber connected by a passageway;

a cylinder block disposed in said compressor housing and, a plurality of cylindrical formed in said cylinder block;

a plurality of pistons, each of said pistons being reciprocatingly carried in a respective one of said cylinders;

a drive mechanism coupled to said pistons to reciprocate said pistons within said cylinders, said drive mechanism including a drive shaft rotatably supported in said compressor housing, a rotor coupled to said drive shaft and rotatable therewith, and coupling means for coupling said rotor to said pistons such that the rotary motion of said rotor is converted into reciprocating motion of said plate, said coupling means including a member having a surface disposed at an incline angle relative to said drive shaft, said incline angle of said member being adjustable to vary the length of the reciprocating stroke of the said pistons and thereby vary the capacity of the compressor;

valve means for controlling the closing and opening of said passageway in response to changes in refrigerant pressure in said compressor, said valve means including a valve to directly close and open said passageway, means for applying a biasing force to said valve in a direction to close said passageway, and means for varying the amount of said applied biasing force; and said means for applying a biasing force comprising a bellows element, said means for varying the amount of the applied biasing force comprising means for applying an adjustable negative pressure force to said bellows element including a conduit for coupling to a source of variable negative pressure.

12. The refrigerant compressor of claim 11 wherein said conduit communicates directly with said bellows element.

13. The refrigerant compressor of said claim 12 wherein said bellows element comprises a generally cylindrical shaped collapsible bellows.

14. The refrigerant compressor of claim 12 wherein said bellows element comprises a movable diaphram.

15. The refrigerant compressor of claim 11 wherein said means for varying the amount of said applied biasing force further comprises a movable diaphram and connecting rod, said connecting rod being coupled between said bellows element and said diaphram, and said diaphram being movable in response to the adjustable negative pressure applied through said conduit.

16. The refrigerant compressor of claim 15 wherein said bellows element comprises a generally cylindrical shaped collapsible bellows.

* * * * *

UNITED STATES PATENT AND TRADEMARK OFFICE

CERTIFICATE OF CORRECTION

PATENT NO. : 4,842,488

DATED : June 27, 1989

INVENTOR(S) : Kiyoshi Terauchi

It is certified that error appears in the above-identified patent and that said Letters Patent is hereby corrected as shown below:

Column 7, line 27, "wass" should be —wall—.

Signed and Sealed this

Twenty-fourth Day of April, 1990

*Attest:*

HARRY F. MANBECK, JR.

*Attesting Officer*

*Commissioner of Patents and Trademarks*